US005130756A

United States Patent [19]

Taniyama

[11] Patent Number: 5,130,756

[45] Date of Patent: Jul. 14, 1992

[54] UNIT FOR CONVEYING DEVELOPER

[75] Inventor: Yoshiharu Taniyama, Yokohama, Japan

[73] Assignee: Kabushiki Kaisha Toshiba, Kawasaki, Japan

[21] Appl. No.: 603,164

[22] Filed: Oct. 25, 1990

[30] Foreign Application Priority Data

Oct. 27, 1989 [JP] Japan ..... 1-278705

[51] Int. Cl.[5] ..... G03G 21/00

[52] U.S. Cl. ..... 355/298; 118/652; 118/653; 198/659; 222/412; 222/413; 222/DIG. 1

[58] Field of Search ..... 198/659; 118/652, 653; 222/412, 413, DIG. 2; 355/245, 253, 298

[56] References Cited

U.S. PATENT DOCUMENTS 4,627,716 12/1986 Oka ..... 118/653 X 4,819,578 4/1989 Koiso et al. ..... 118/652

4,894,688 11/1990 Taniguchi et al. ..... 355/298

4,943,830 7/1990 Sulenski ..... 355/245

*Primary Examiner*—A. T. Grimley

*Assistant Examiner*—P. Stanzione

*Attorney, Agent, or Firm*—Foley & Lardner

[57] ABSTRACT

A guiding opening is provided at the upper part of the side wall of a vertical conveying duct when the duct side wall extends horizontally. The upper end of the conveying auger 40 located in the vertical duct is bent sideward so as to be introduced into the guiding opening, and this introduced end portion is pivoted on the pivot portion. In such a manner, the end portion is rotatably pivoted and the other end is set free. Thus, developer introduced into the vertical conveying duct is carried thereinto in the axial direction of the conveying auger, and conveyed by rotation of the auger. Then, developer is exhausted in the axial direction.

6 Claims, 7 Drawing Sheets

UNIT FOR CONVEYING DEVELOPER

BACKGROUND OF THE INVENTION

1. Field of the Invention

The present invention relates to a unit for conveying developer, and more particularly to a developer-conveying unit for conveying toner exhausted from the cleaning unit of an electronic copying machine.

2. Description of the Related Art

In an electronic copying machine, a latent image is formed on a photosensitive drum, and this image is transcribed on a sheet of paper, and developed with toner. The toner which remains on the photosensitive drum after completion of copying of the image, is removed by a cleaning unit. The toner, thus removed, is conveyed by a conveying device into a collection box.

The conveying apparatus comprises a cylindrical conveying duct 100 in which an auger 102 is contained.

The auger 102 is rotatably pivoted to the conveying duct 100 and supported at both ends by bushing 104. The bushings 104 are in direct contact with toner, and, therefore, are stained with toner. The bushings, if stained, disable, in some cases, the conveying auger 102 from rotating. In order to avoid this problem, the bushings must be made of a material to which toner does not stick, or must be sealed to be free from contact with the toner. However, either method is costly.

Further, since both ends of the auger 102 are pivoted, toner cannot be supplied and exhausted in the axial direction of the auger 102. Consequently, the auger 102 cannot be used in a vertical section of the conveying unit shown in FIG. 2. Actually, the toner is made to fall freely, but in some case, part of the toner 106 inevitably sticks to the inner surface of the vertical section 108 as shown in FIG. 3, affecting smooth conveyance of the toner.

SUMMARY OF THE INVENTION

The purpose of the present invention is to provide a conveying unit for a developer in which a conveying member can be rotated smoothly without selecting a special material for the bushings or sealing them, and the conveying direction of the developer is not limited by shaft supporting portions.

According to the invention, there is provided a conveying unit for a developer comprising: means for guiding a developer to be conveyed therein; means for conveying said developer in a predetermined conveying direction by rotating, which is rotatably located in said guiding means and has one end portion; means for receiving the one end portion of said conveying means, which is provided in said guiding means, said conveying means being elongated in said guiding means and bent into said receiving means; means for rotatably supporting the one end portion of said conveying means and provided on said receiving means; and means for rotating said conveying means. There is also provided a conveying unit for a developer comprising: means for transferring a developer in a first direction; means for guiding the transferred developer in a second direction different from the first direction, including a recess portion; means for conveying said developer, which has one end portion received in the recess portion, is elongated in said guiding means and bent into the recess portion; means, provided in the recess portion, for supporting the one end portion of said conveying means; and means for applying a vibration to said conveying means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

The developer conveying unit of the present invention will be described with reference to an embodiment shown in FIGS. 4 to 8.

Figure 5:
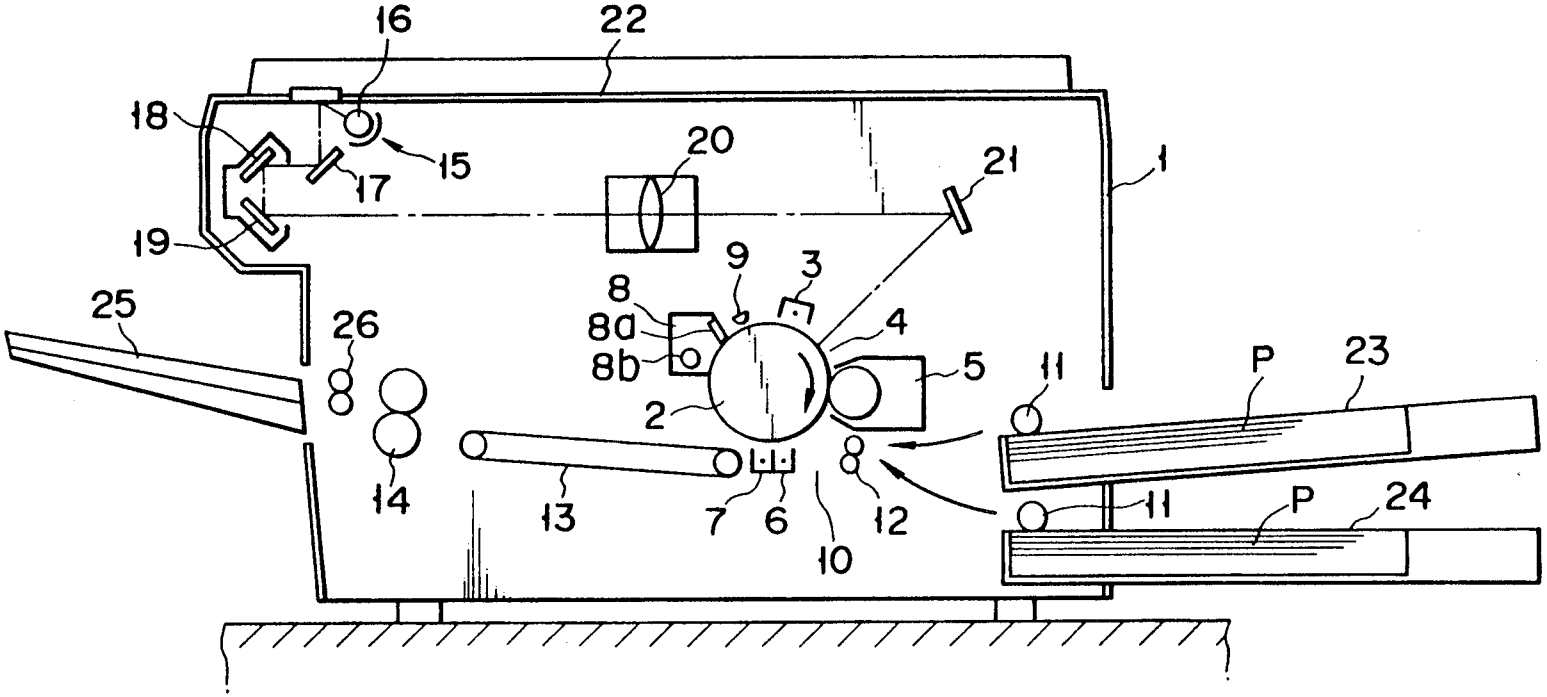
FIG. 5 is a schematic view of an electronic copying machine which comprises the conveying unit shown in FIG. 4.

FIG. 5 shows an electronic copying machine with a main body 1 of the copying machine. A photosensitive drum 2 is provided rotatably in the main body 1. A charging body 3 is provided at the upper portion of the photosensitive drum 2 so as to charge uniformly over the surface thereof. A developer holder 5 is provided at one side of the photosensitive drum 2 for supplying the developer to a static latent image formed on the photosensitive drum 2. A transcription charger 6 and a removal charger 7 are provided both at the lower portion of the photosensitive drum 2, for transcribing an image formed on the photosensitive drum 2 onto a sheet P, and for removing the sheet P onto which the image has been transcribed from the photosensitive drum 2, respectively. A cleaning unit 8 is provided at the other side of the drum 2 for cleaning off developer remaining on the drum 2. A discharger 9 is for discharging the surface of the photosensitive drum 2.

A cleaning blade 8*a* is provided at the inner upper side of the cleaning unit 8, and a toner conveying auger 8*b* is provided at the lower side thereof A carrying path 10 is provided at the inner lower side of the cleaning unit 8 and this carrying path 10 comprises a straightening roller 12 for carrying a sheet P between the transcription charger 6 and the photosensitive drum 2.

The carrying path 10 has a carrying belt 13 on which a sheet P is placed. This carrying belt 13 has, at the carrying out side, a fixing unit 14 for fixing the image transcribed onto the sheet P and a carrying out roller 26.

A exposure mechanism 15 is provided at the inner upper portion of the main body 1 of the copying machine. This exposure mechanism 15 includes an exposure lamp 16, first to third mirrors 17–19, lens 20, and a fourth mirror 21. The exposure lamp 16 and the first mirror 17 are loaded on the first carriage, and the second and third mirrors 18 and 19 are loaded on the second carriage (both carriages not shown in the figure). The first and second carriages are provided movably along an original base 22, and the second carriage moves in the same direction as the first carriage but at half the speed thereof.

Paper-feeding cassettes 23 and 24 are detachably mounted at one side of the main body 1 of the copying machine, and a paper receiving tray 25 at the other end.

Figure 1:
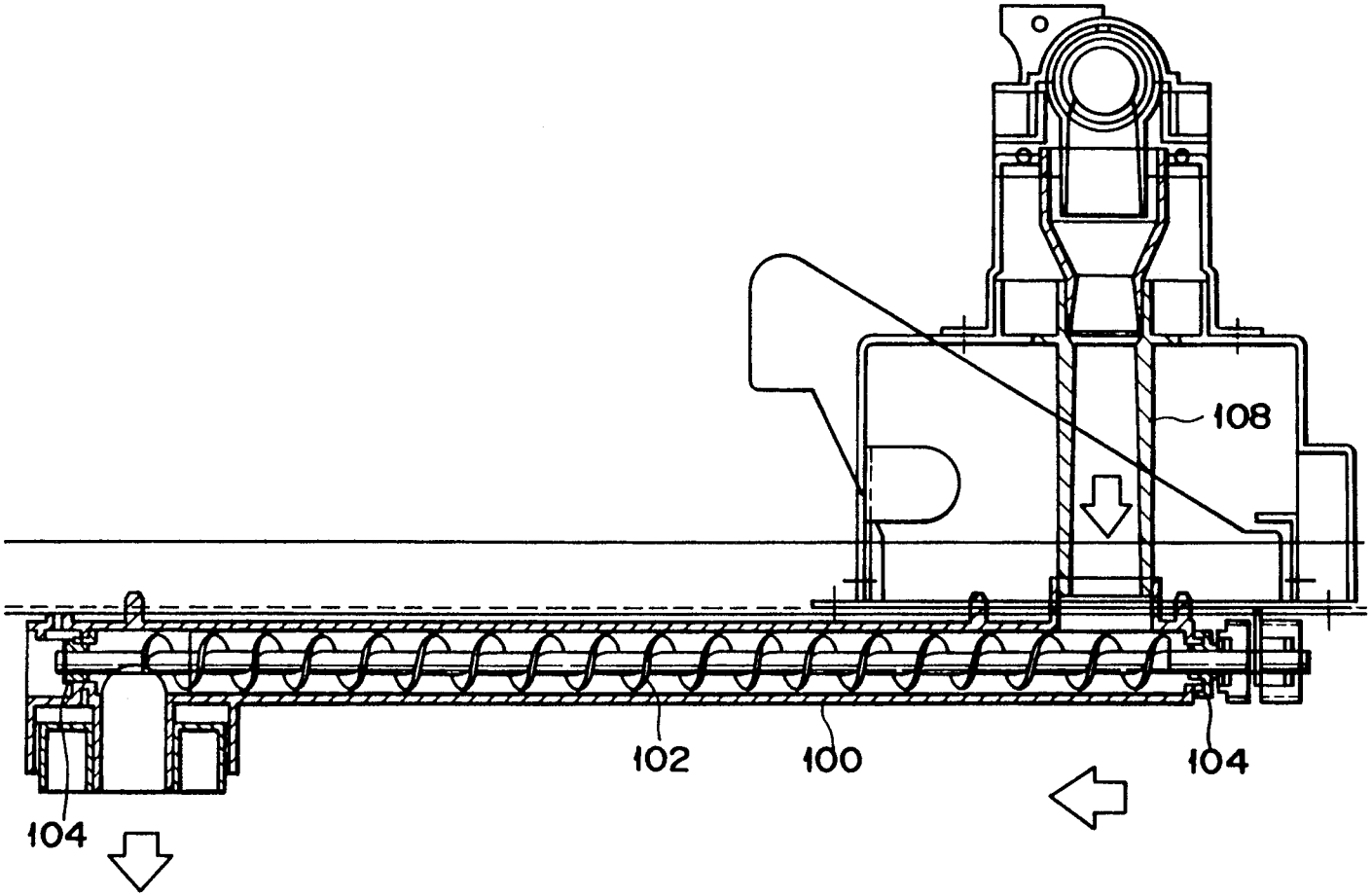
FIG. 1 shows the structure of a conventional developer conveying unit.
Figure 2:
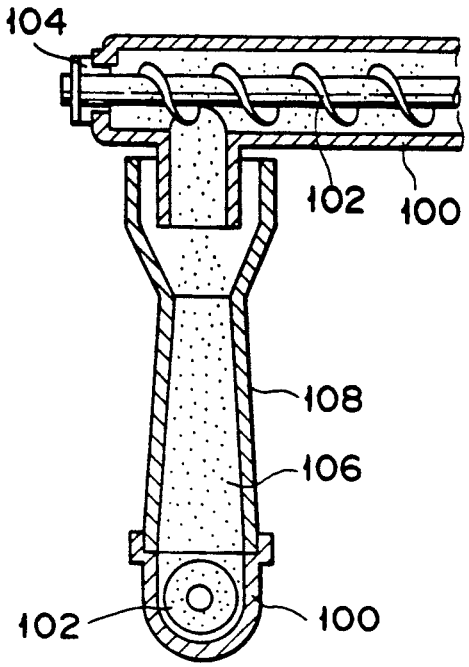
FIG. 2 is a side cross-sectional view of the vertical section of the developer conveying means shown in FIG. 1.
Figure 3:
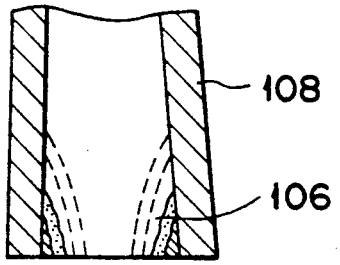
FIG. 3 illustrates a state in which toner stays in the vertical section shown in FIG. 2.
Figure 4:
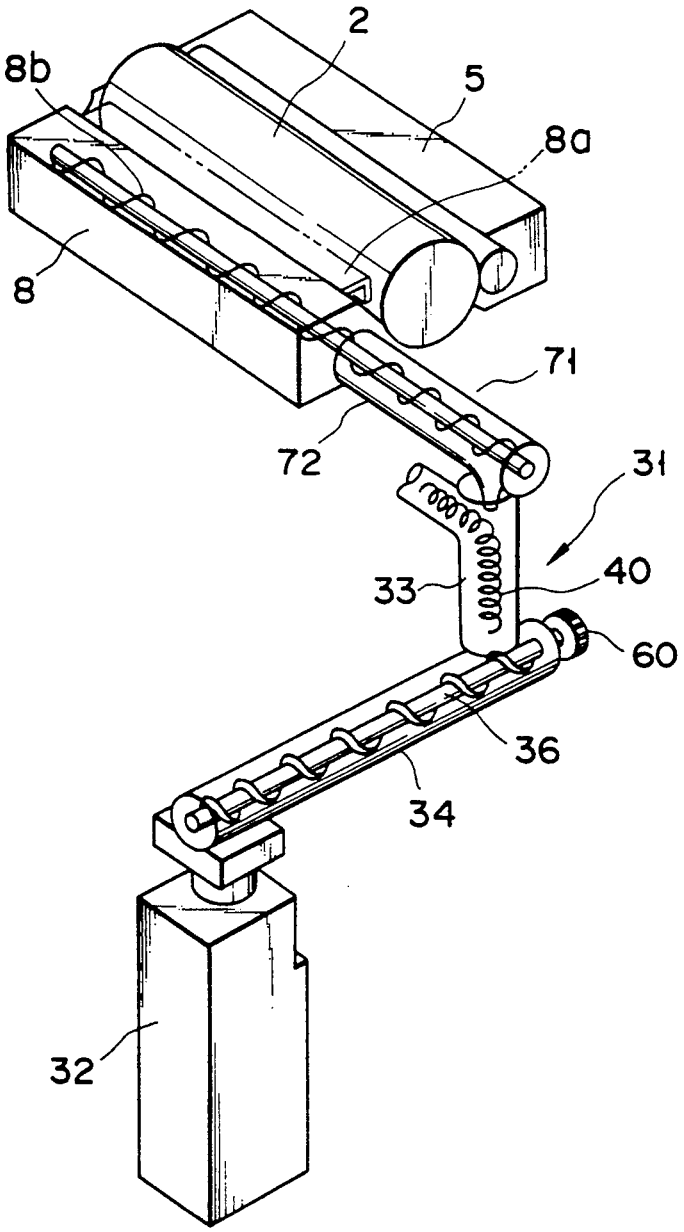
FIG. 4 is a diagonal view of a developer conveying unit according to an embodiment of the present invention.

As is shown in FIG. 4, waste toner box 32 is connected to the cleaning unit via a toner carrier 31.

The toner conveyer 31 consists of a first horizontal section 71, a vertical section 33, and a second horizontal section 34.

The first horizontal section 71 has a conveying duct 72 as a guiding means, and the conveying auger **8*b* is inserted to this conveying duct 72. Both ends of the conveying auger 8*b*** are rotatably supported by means of bushings not shown in this figure.

Figure 7:
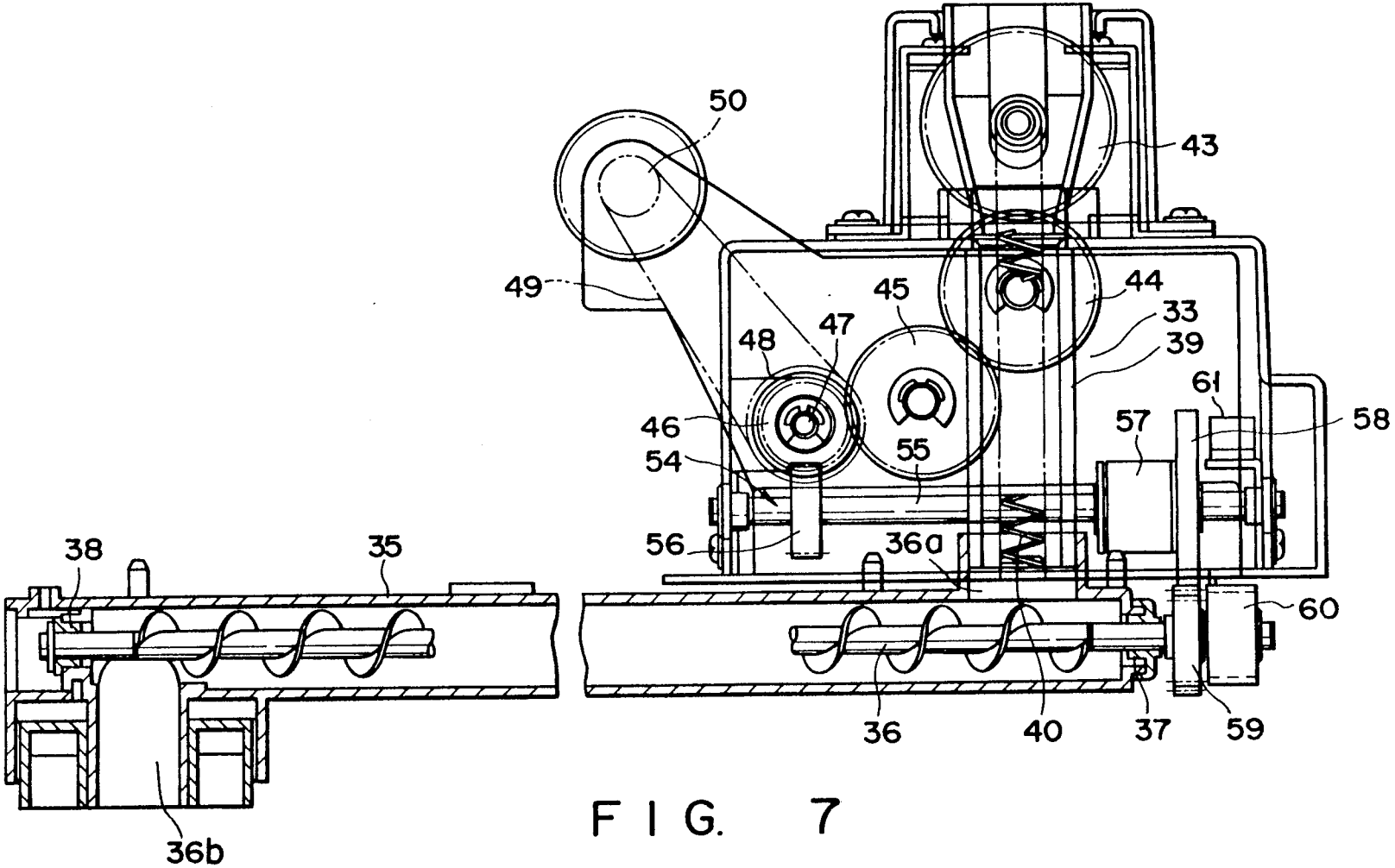
FIG. 7 is a cross-sectional view of the developer conveying unit shown in FIG. 4.

The second horizontal conveying path 34 has, as shown in FIG. 7, a cylindrical duct 35, and a spiral-shaped conveying auger 36 is located therein. Both ends of the conveying auger 36 are pivoted rotatably on the conveying duct 35 by means of the bushings 37 and 38.

A toner introducing opening **36*a* is provided at one end of the conveying duct 35, and a toner exhausting opening 36*b*** is provided at the other end thereof.

Figure 6:
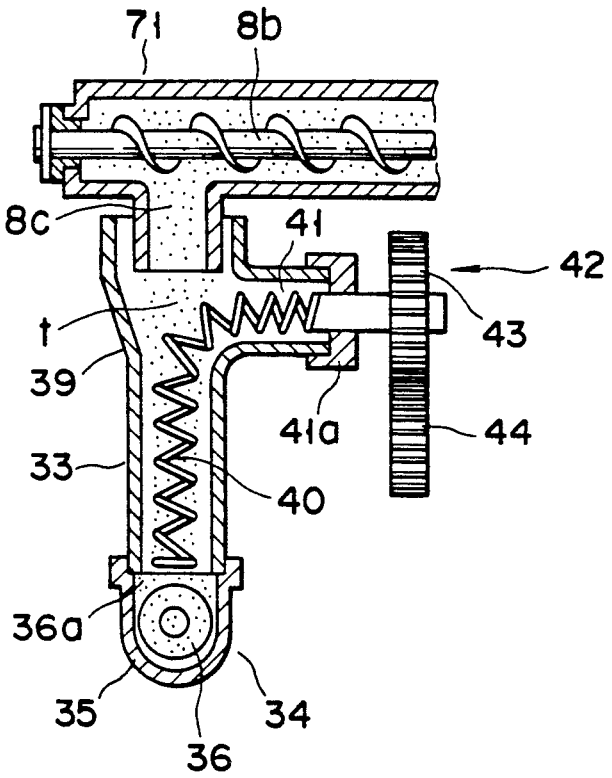
FIG. 6 is a side cross-sectional view of the vertical section of the conveying unit shown in FIG. 4.

The vertical section 33, as shown in FIG. 6, has, as a cylindrical duct, a conveying duct 39, in which a conveying auger 40, formed as a flexible coil-like conveying means, is located. This conveying auger 40 is made of spring steel. A guiding opening 41 protrudes in the horizontal direction on the upper side wall of the conveying duct 39. The upper end portion of the conveying auger 40 is bent sideward and introduced into the guiding opening 41, and the other end is set free. The end portion of the conveying auger 40 which is introduced into the guiding opening 41 is pivoted rotatably by means of the pivot portion 41. A driving means 42 is connected to an end of the conveying auger 40 thus pivoted.

Figure 8:
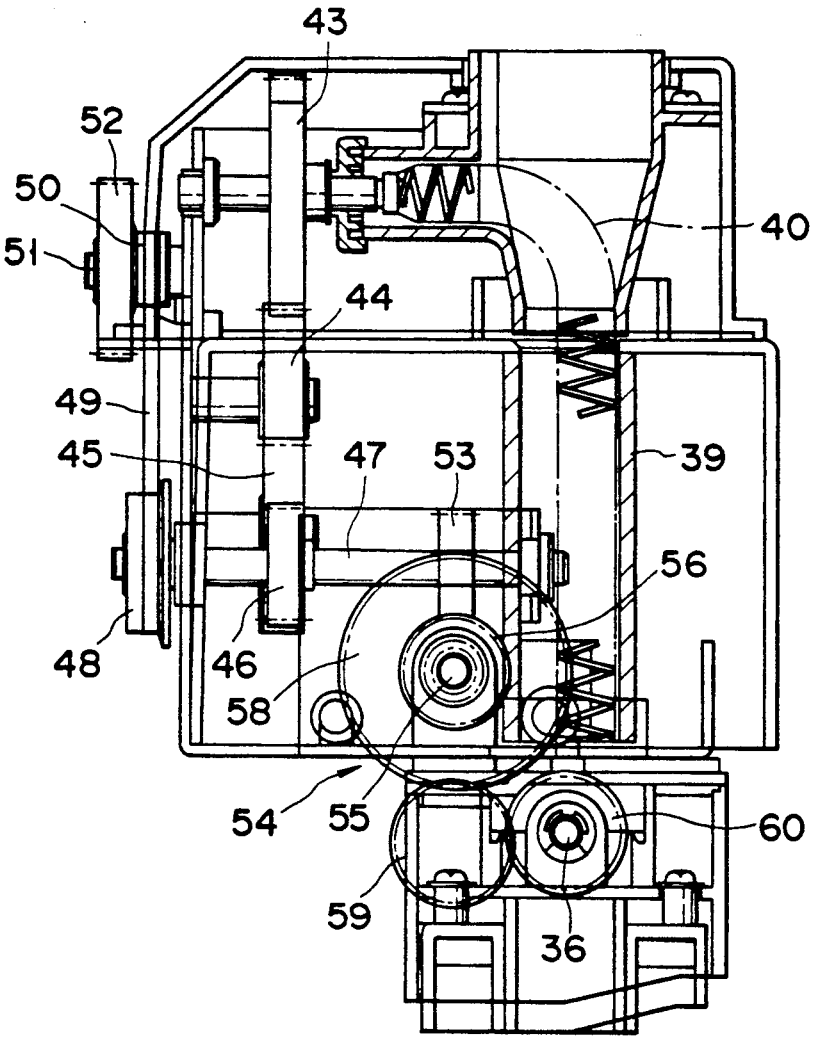
FIG. 8 is a front view of the developer conveying unit shown in FIG. 4.

The driving means 42, as shown in FIGS. 7 and 8, comprises a plurality of gears 43, 44, 45, and 46. A pulley 48 is mounted on one end of the rotation shaft 47 of the gear 46, and the pulley 48 is coupled with the pulley 50 by means of the driving belt 49. The driving gear 52 is mounted on the shaft 51 of the pulley 50.

When the driving gear 52 is rotated by means of a driving motor not shown in the figure, and rotation of the pulley 50 runs the driving belt 49. Thus, the pulley 48 is rotated, thereby rotating the gear 46. Rotation of the gear 46 rotates the gears 45, 44, and 43, in mentioned order, and thus the conveying auger 40 is rotated.

A gear 53 is mounted o the other end of the rotation shaft 47 of the gear 46. The gear 53 is connected to the conveying auger 36 of the horizontal section 34 via a power propagating mechanism 54.

The power propagating mechanism 54 has a gear 56 which interlocks with the gear 53 located at one end of the rotation shaft 55, and a gear 58 is mounted at the other end by means of the spring clutch 57. A gear 59 is engaged with the gear 58, and one end of the conveying auger 36 is connected to the gear 59 via a gear 60.

Detection unit 61 detects plugging of toner in the conveying auger 36.

With the above mentioned structure, upon forming an image, the exposure lamp 16 irradiates an original placed on the original base 22, and the reflection light from the original forms an image on the photosensitive drum 22 via the first to third reflection mirrors 17 to 19, lens 20, and the fourth reflection mirror 21. The surface of the photosensitive drum 2 is charged by means of the electrical charger 3, a static latent image of the original is formed thereon. This static latent image is carried to the developer holder 5 a the drum 2 rotates, an toner is supplied from the holder 5 to the surface of the drum, thereby developing the original image.

In the meantime, a sheet P is withdrawn from the paper-feeding cassette 23 or 24 by means of paper-feeding roller 11 so as to be carried between the photosensitive drum 2 and the transcription charger 6 by means of the straightening roller 12, and thus the image is transcribed on the sheet. The image-transcribed sheet P is removed from the photosensitive drum 2 by means of removal charger 7. Then, the sheet thus removed is carried to the fixing unit 14, where the image is fixed, and discharged to the paper receiving 25 by means of a paper-discharging roller 26. Further, toner remaining on the photosensitive drum 2 after completing the image transcription, is cleaned off by the cleaning blade of the cleaning unit 8. Thereafter, the electrical charge of the photosensitive drum 2 is discharged and equalized by the discharger 9, and the drum stands by for the next process.

Toner t cleaned off by the cleaning blade **8*a* of the cleaning unit 8 is conveyed into the conveying duct 72 of the first horizontal section 71 by rotation of the conveying auger 8*b* in the cleaning unit 8 shown in FIG. 4, and exhausted from the exhaustion opening 8*c* downward. The toner t is thus introduced into the conveying duct 39 of the vertical section 3 as shown in FIG. 6. The conveying auger 40 is rotated by the driving means 42 forcing the toner t to move from the lower end opening to the second horizontal section 34 via the toner introduction opening 34*a*. This toner t is conveyed to the conveying auger 36 which is rotated by the driving means 42, and dumped from the toner exhaustion opening 36*b* into the waste toner box 32**.

As described, the guiding opening 41 is provided at the upper part of the side wall of the conveying duct 39 of the vertical section 33 as it protrudes in the horizontal direction. The upper end of the conveying auger 40 is bent sideward so as to be introduced into the guiding opening 41, and this introduced end portion is pivoted on the pivot portion **41*a*. In such a manner, the pivot portion 41*a* of the conveying auger 40 is located outside the conveying path for the toner t, whereby the pivot portion 41*a* is kept from being in direct contact with toner t and is not contaminated by the toner. Thus, the conveying auger 40 can be freely rotated without selecting a special material for the pivot portion 41*a*** or sealing the auger.

Moreover, since the pivot portion 41*a* of the conveying auger 40 is located outside the conveying path for toner t, and the lower end of the auger 40 is set free, flow of toner t in the axial direction of the conveying auger 40 is not blocked by anything, whereby not only toner t can be conveyed in the vertical direction, but also the area where toner is conveyed, can be enlarged.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

means for forming an image onto an image bearing member by providing image developing particles;

means for removing used image developing particles from the image bearing member;

means for collecting the removed developer particles;

means for guiding the removed developer particles to said collecting means, the guiding means being located between a first horizontal guide path and a second horizontal guide path, and substantially perpendicular to each said horizontal guide path, the guiding means receiving the developer discharged from the first horizontal guide path, the developer being conveyed to the second horizontal guide path by conveying means in the same direction as it is received;

means for conveying the removed developer particles in a predetermined conveying direction by rotating said conveying means, which is rotatably located in said guiding means;

means for receiving one end portion of said conveying means, which is provided in said guiding means, said conveying means being elongated in said guiding means and bent into said receiving means;

means for rotatably supporting the one end portion of said conveying means provided on said receiving means; and means for rotating said conveying means.

2. A conveying unit for a developer according to claim 1, wherein said supporting means includes means for freely rotatably pivoting the one end of said conveying means.

3. A conveying unit for a developer according to claim 1, wherein said conveying means has the other free end portion.

4. A conveying unit for a developer according to claim 1, wherein said conveying means is flexible.

5. A conveying unit for a developer according to claim 1, wherein said conveying means includes a coil-like structure.

6. A conveying unit for a developer according to claim 1, wherein said conveying means includes a steel spring made of iron based material.

* * * * *